US006743046B2

(12) United States Patent
Rus

(10) Patent No.: US 6,743,046 B2
(45) Date of Patent: Jun. 1, 2004

(54) VIDEO/DATA QUICK CONNECT SYSTEM FOR MONITOR SUSPENSION ARMS

(75) Inventor: Steven H. Rus, Chardon, OH (US)

(73) Assignee: Steris Inc., Temecula, CA (US)

( * ) Notice: Subject to any disclaimer, the term of this patent is extended or adjusted under 35 U.S.C. 154(b) by 0 days.

(21) Appl. No.: 10/264,154

(22) Filed: Oct. 3, 2002

(65) Prior Publication Data

US 2003/0064624 A1 Apr. 3, 2003

Related U.S. Application Data

(60) Provisional application No. 60/326,867, filed on Oct. 3, 2001.

(51) Int. Cl.[7] ..... H01R 13/60

(52) U.S. Cl. ..... 439/537; 439/527; 248/274.1; 248/917

(58) Field of Search ..... 439/537, 527; 248/917–924, 274.1–299.1

(56) References Cited

U.S. PATENT DOCUMENTS 5,398,359 A * 3/1995 Foster ..... 5/658
5,808,680 A 9/1998 Steckhan ..... 348/370
5,818,638 A * 10/1998 Nakamura ..... 359/384
6,293,506 B1 * 9/2001 Gutgsell et al. ..... 248/188.1
6,364,268 B1 * 4/2002 Metelski ..... 248/317
6,601,811 B1 * 8/2003 Van Lieshout et al. .. 248/282.1
2002/0014562 A1 * 2/2002 Twisselmann ..... 248/123.11

OTHER PUBLICATIONS

International Publication No. WO 01/45627 A1; Jun. 28, 2001.
International Publication No. WO 01/45627 A1—Corrected Version; Jun. 28, 2001.
International Search Report for International Application No. PCT/US 02/31762; Oct. 10, 2002.

* cited by examiner

*Primary Examiner*—Michael C. Zarroli
(74) *Attorney, Agent, or Firm*—Fay, Sharpe, Fagan, Minnich & McKee, LLP

(57) ABSTRACT

A video/data/power quick connect system is provided for use with medical appliance suspension arms. A universal cable bundle (40) extends along a monitor suspension arm (12). A first hub harness (50) adapts the cable bundle (40) for connection to a first associated source (68) of video/data/power signals. A first monitor harness (60) connects a lower end of the cable bundle (40) for connection to a first associated monitor device (34). A second hub harness (50') and second monitor harness (60') are provided for adapting the cable bundle (40) for connection to a second source (68) of associated video/data/power signals and a second associated monitor device (34'), respectively.

17 Claims, 3 Drawing Sheets

VIDEO/DATA QUICK CONNECT SYSTEM FOR MONITOR SUSPENSION ARMS

CROSS-REFERENCE TO RELATED APPLICATION

This application claims the benefit of U.S. provisional application Serial No. 60/326,867, filed Oct. 3, 2001.

BACKGROUND OF THE INVENTION

The present invention is directed to the art of surgical lighting and accessory systems and, more particularly, to a quick connect system for use with electrical wiring in medical appliance suspension arms. The present invention finds particular application in connection with surgical monitors and other medical devices and apparatus requiring power, data, video or other forms or types of electrical or electronic signals, and will be described with reference thereto. However, it is to be appreciated that the subject quick connect system can be used in applications other than medical accessory suspension arm systems such as, for example, in industrial, commercial, educational and other settings and uses.

Presently, a wide range of patient monitoring equipment is available for use to track the medical progress of patients during surgery. The patient monitoring and support devices have typically crowded the surgical operating room floor.

Overhead surgical device management systems provide one solution to the problem of cluttered operating room floors. In those systems, one or more patient monitoring apparatus are carried on a set of shelves suspended from overhead by one or more auxiliary support arms of a surgical lighting system. The support systems typically include one or more movable arm segments adapted to support the patient monitoring devices from overhead at a central hub member. Each of the arms includes jointed ends so that the shelf carrying the one or more monitoring devices can be manually moved into place to best accommodate the needs of the surgical personnel.

Many current surgical device management systems with monitor support arms, however, offer only a single set of monitor support cabling and connectors. Many do not offer computer video capability such as SVGA. This often results in the inability to use certain monitors from overhead suspension arms and the inability to change monitor types because, simply, the appropriate video cables are not provided in the support arms. In those instances, monitors with computer video capability are placed on carts or other portable devices adjacent the surgical site, because it is impractical to disassemble the device management support arm to provide the necessary wiring needs to support the equipment. The carts and portables, of course, add to the undesirable operating room clutter.

In order to support high-end video and data transfer needs, specialized cables must be installed in the overhead support arms during their manufacture. However, this adds additional time to delivery of the overhead suspension systems, adds to their cost, and is usually not upgradable after the system is installed. Further, when only a single video cable/connector of a particular type is initially provided, surgeons and operating room management personnel are unable to switch between different video sources and are compromised by the single source type supported by the cables/connector type provided. Upgrades to different video/data needs require disassembly of the support arm.

SUMMARY OF THE INVENTION

The present invention provides a new video quick connect system for use with suspension arms in a surgical operating room. The invention enables a single monitor suspension arm to be used to support and carry video signals, data signals, power cables and wire, and other types of electrical and electronic signals to a wide range of patient monitoring and video display devices without the need to remove the support arm from service for a hardware upgrade.

In accordance with one aspect of the present invention, a video/data quick connect system is provided for a monitor suspension arm in a surgical operating room. The quick connect system includes a universal cable bundle extending along the monitor suspension arm, a hub harness for connecting a hub end of the cable bundle to a first associated source of power or video signals, and a monitor harness for connecting a lower end of the cable bundle to a first associated patient monitor or display device. The signal quick connect system further includes a second hub harness to be used in place of the first hub harness for connecting the hub end of the universal cable bundle to a second associated source of power or video signals. Still further, the video quick connect system includes a second monitor harness for use in place of the first monitor harness for connecting the lower end of the universal cable bundle to a second associated patient monitor or display device.

One major advantage of the subject video quick connect system is that it allows users to select the type of data, power, and video connection needs shortly before installation of the surgical equipment suspension arm rather than months ahead of time of purchase of the arm. The connector kits are used to enable quick, simple, and inexpensive retrofits and upgrades of the patient monitors and display devices supported by the suspension arm and offer flexibility for different operating room needs.

In accordance with another aspect of the invention, the video quick connect system enables surgical equipment suspension arm hardware to support video, signal, power, and data types and standards developed or implemented after the suspension system is physically installed by using existing cables in the universal cable bundle with the simple substitution of video quick connect kits assembled to support the new signal standard(s) or by selection of suitable connections on either end of the universal cable bundle.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
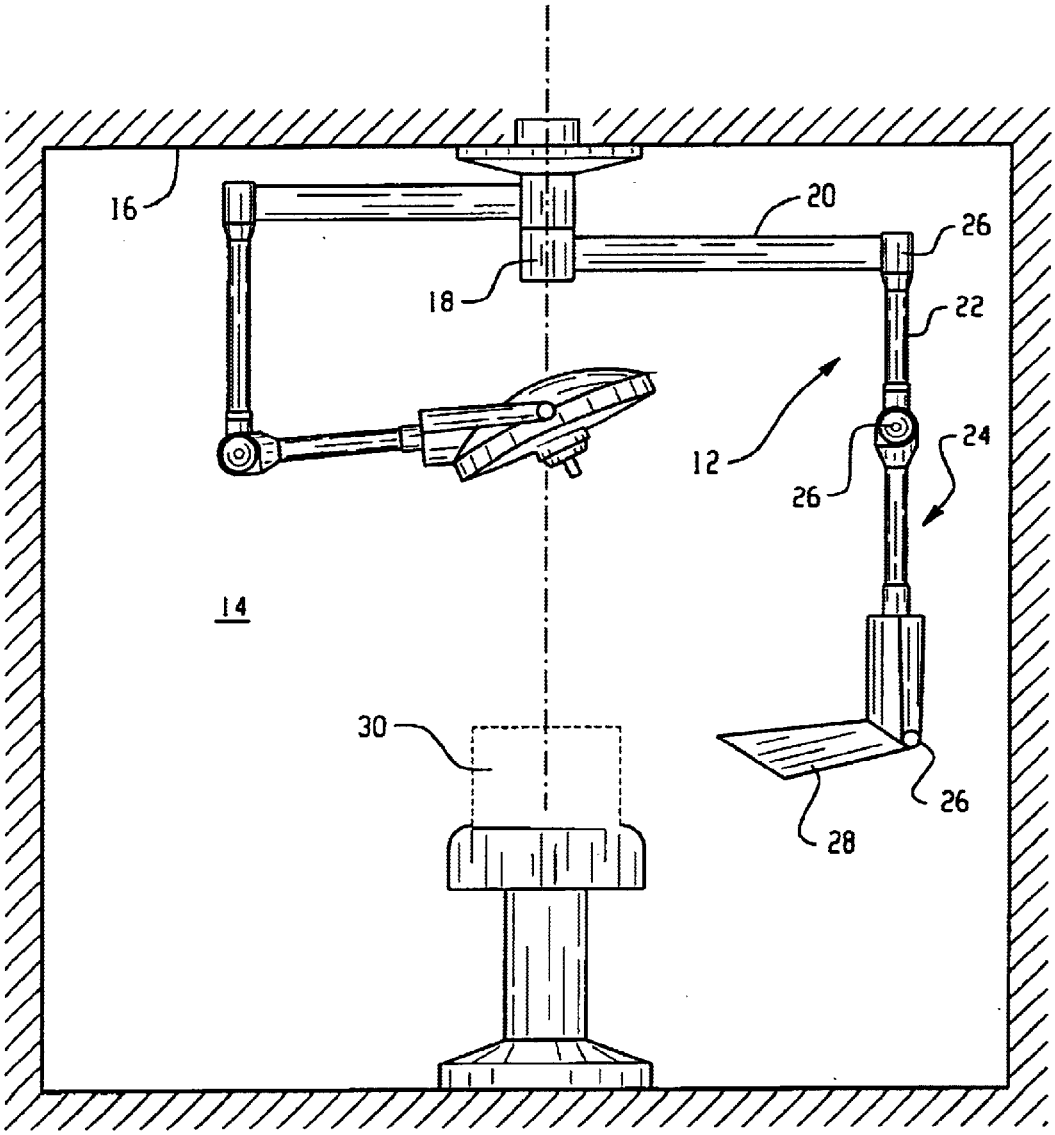
FIG. 1 is a diagrammatic illustration of a surgical operating room showing a surgical equipment suspension arm connected to an operating room ceiling.

In accordance with the invention and with reference to the drawing FIGURES, a video/data quick connect system 10 is provided for a monitor suspension arm 12 in a surgical operating room 14. The subject system provides a convertible electrical connection system to enable video, data and power equipment changes without the need to disassemble or retrofit the suspension arm. As shown best in FIG. 1, the monitor suspension arm 12 is connected to the ceiling 16 of the operating room 14 at a central hub 18. As understood in the art, the monitor suspension arm 12 includes a horizontal arm member 20, a vertical arm member 22, and a lower arm and yoke system 24. A plurality of joints 26 allow a monitor support shelf 28 carried on the lower end of the monitor suspension arm 12 to be moved as needed into position adjacent the surgical site 30. It is to be appreciated that although a shelf is shown, the monitor may be coupled to the suspension arm by means of a suitable pivot joint or the like.

Figure 2:
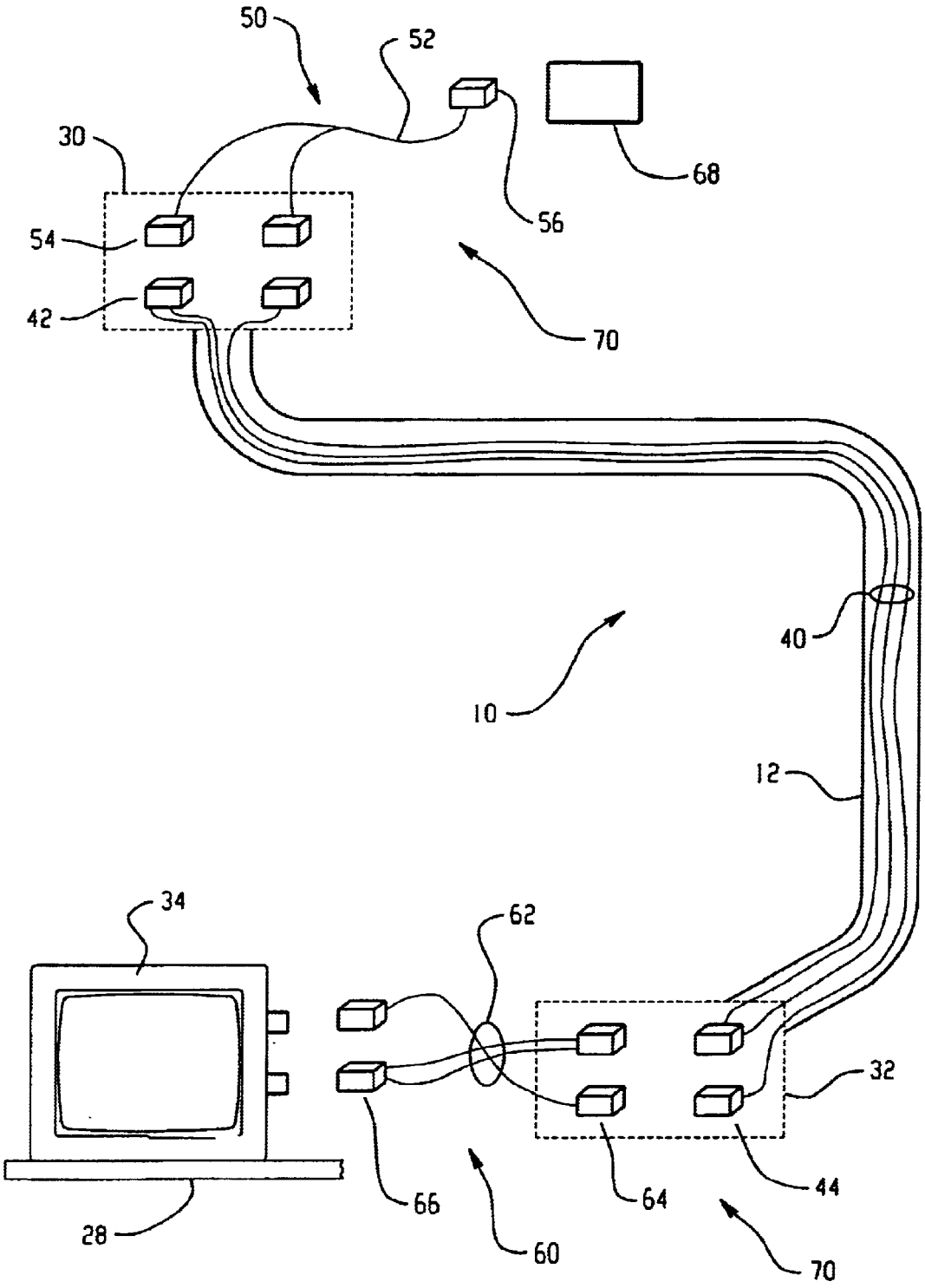
FIG. 2 is a schematic illustration of the subject video/data quick connect system formed in accordance with the present invention; and, FIG. 3 is a schematic illustration of the subject video/data quick connect system of the present invention configured for use with a second set of monitor and source device.

As shown schematically in FIG. 2, the subject video/data quick connect system 10 includes a universal cable bundle 40, a hub harness 50, and a monitor harness 60. The bundle of cables 40 extends along the monitor suspension arm 12 from the hub end 30 to the lower end 32 adjacent the monitor support shelf 28. A monitor 34 is illustrated carried on the support shelf 28. A set of hub connectors 42 are provided on the upper end of the bundle 40 at the hub area 18. Similarly, a set of monitor connectors 44 are provided on the lower end of the cable bundle 40 at the lower end 32 of the monitor suspension arm 12. The set of hub connectors 42 preferably includes at least two individual physical connectors as illustrated so that power signals remain separated from video and data signals. Similarly, the set of monitor connectors 44 include at least two individual physical connectors as the mirror image of hub connectors so that the video and data signals remain separated from the power signals. Further, preferably, the cable bundle 40 includes a plurality of individual cables to provide shielding and isolation between the power, video, data, and other signals that are carried on the universal cable bundle 40.

With continued reference to FIG. 2, the hub harness 50 includes a hub cable bundle 52 and first and second sets of connector members 54, 56 on opposite ends of the cable bundle. Similarly, the monitor harness 60 at the lower end of the monitor suspension arm includes a monitor cable bundle 62 and first and second sets of connector members 64, 66 on opposite ends of the cable bundle. It is to be appreciated that the first set of connector members 54 of the hub cable harness 50 is intermatable with the set of hub connectors 42. Similarly, the first set of connector members 64 of the monitor cable harness 60 is intermatable with the set of monitor connectors 44. Still further, it is to be appreciated that the second set of monitor connector members 66 is intermatable with the monitor 34 carried on the monitor support shelf 28. Lastly, the second set of connector members 56 of the hub cable harness 50 is intermatable with an associated source 68 of power, video or data signals located above the ceiling 16 of the operating room 14.

In the preferred embodiment illustrated, the universal cable bundle 40 is pre-loaded within the monitoring suspension arm 12 before it is installed at the hospital site. Preferably, at least six (6) high quality video cables, eight (8) signal wires, and three (3) power wires comprise the preferred embodiment of the universal cable bundle 40. All signals are tied to similar connectors at both the hub connector set 42 and the monitor connector set 44.

A video quick connect kit 70 includes the hub cable harness 50 and monitor cable harness 60 for adapting the cable bundle 40 within the suspension arm 12 for use with one of a plurality of monitor types and with a range of video, data and power sources. In the present invention, kits are selected based upon the desired monitor type. Each kit 70 consists of a hub cable harness 50 and a monitor cable harness 60. One end of each harness is connected to the standard connector sets fixed to ends of the universal cable bundle 40 and the other end of each harness is connected to either the proper video/power/signal connection at the back of the monitor or the video/power signal/signal connection in the hub. The video quick connect kits 70 allow at least two high quality video connections (SVGA, RGBS, S-Video, composite), signal connections for serial data (e.g. touch panel) or SVGA, and AC or DC power.

Figure 3:
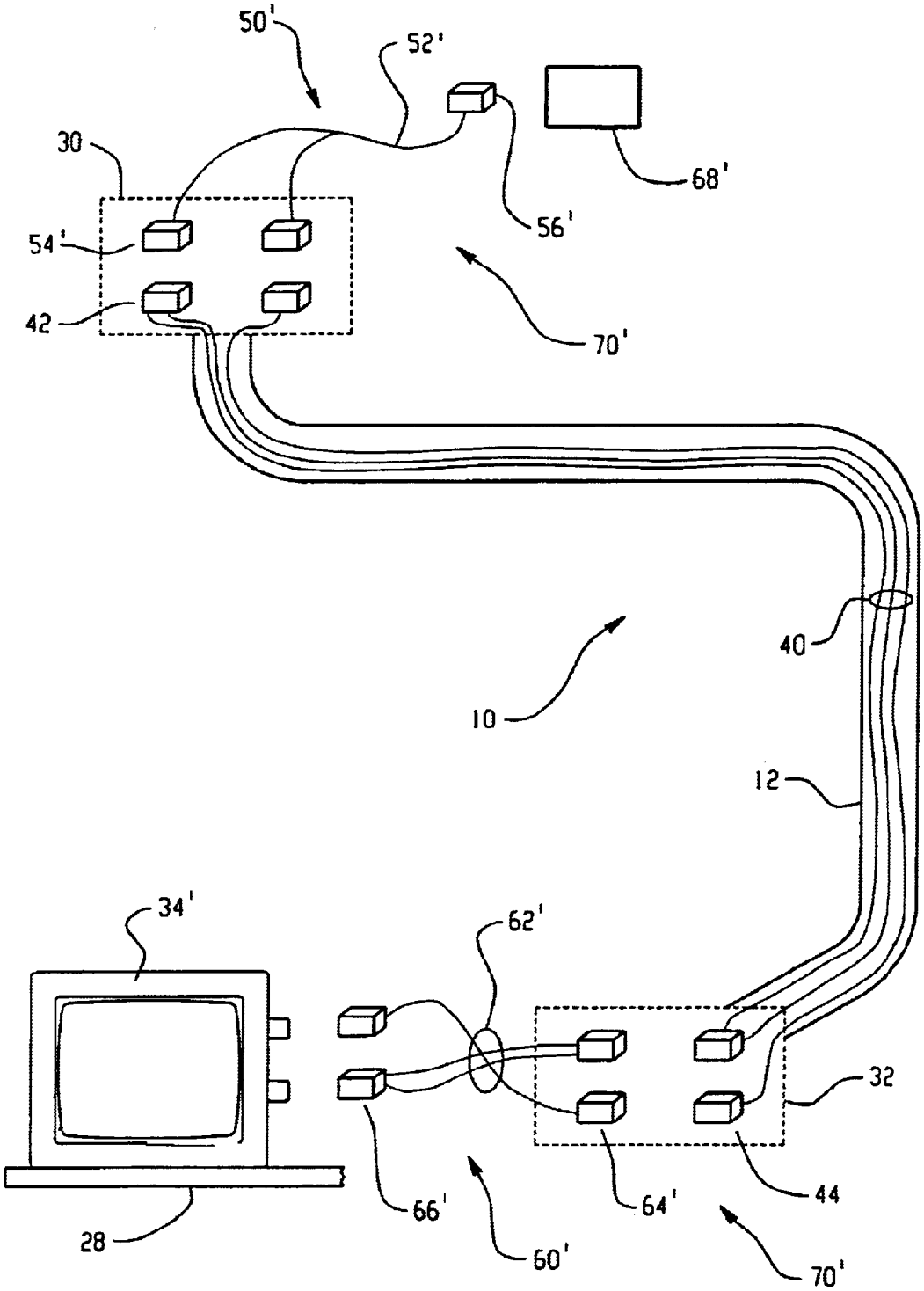

FIG. 3 is a schematic illustration of the subject video/data quick connect system 10 including the universal cable bundle 40 used with a second video quick connect kit 70'. The second video quick connect kit 70' includes a second hub cable harness 50' and a second monitor cable harness 60' for adapting the universal cable bundle 40 within the suspension arm 12 for use with a second monitor 34' and a second source 68' of video/data/power signals. As noted, the video/data quick connect kits are selected based upon the desired monitor type and source. A comparison between the configuration of the present invention for use with the first monitor 34 and first source 68 and the one shown in FIG. 3 used with the second monitor 34' and second source 68' illustrates the manner in which the present invention provides for inexpensive retrofits and upgrades of patient monitors and display devices supported by the suspension arm and cable bundle without the need to assemble the suspension arm.

The video quick connect system 10 allows users to select the type of video connection needs shortly before installation rather than months ahead of time. The connector kits are used to enable quick, simple, and inexpensive retrofits and upgrades of the monitors supported by the suspension arm and offer flexibility for different operating room needs. The pre-installed video and signal cable bundle allows for a very small profile suspension system, thereby reducing clutter in the operating room and making the system more reliable. In the preferred embodiment, video quick connect kits 70 support high quality signal formats including, but not limited to, SVGA and RGBS. Further, the video quick connect kits 70 enable the suspension arm 12 to support video, signal, and data types and standards developed after the suspension system is installed by using existing cables of the bundle 40 with a video quick connect kit 70 assembled to support the new signal standard.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A convertible electrical connect system for use with an associated surgical equipment suspension arm connected at a hub end to a central hub for attaching the suspension arm to a ceiling of an associated operating room, the suspension arm having a lower end opposite said hub end carrying a monitor support shelf adapted to support a first associated monitor device, the convertible electrical connect system comprising:

a cable bundle extending along said monitor suspension arm;

a first hub harness for connecting a hub end of the cable bundle to a first associated source of video signals;

a second hub harness selectively used in place of the first hub harness for connecting said hub end of the cable bundle to a second associated source of video signals;

a first monitor harness for connecting a lower end of the cable bundle to said first associated monitor device (34); and, a second monitor harness selectively used in place of the first monitor harness for connecting said lower end of the cable bundle to a second associated monitor device.

2. The convertible electrical connect system according to claim 1 wherein said cable bundle includes a plurality of individual cables to carry/transmit power, video, data, and other signals between said hub and lower ends of the cable bundle.

3. The convertible electrical connect system according to claim 2 wherein said plurality of individual cables in said cable bundle are shielded and isolated.

4. A convertible electrical connect system for use with an associated surgical equipment suspension arm connected at a hub end to a central hub for attaching the suspension arm to a ceiling of an associated operating room, the suspension arm having a lower end opposite said hub end carrying a monitor support shelf adapted to support a first associated monitor device, the convertible electrical connect system comprising:

a cable bundle extending along said monitor suspension arm;

a first hub harness for connecting a hub end of the cable bundle to a first associated source of video signals;

a second hub harness selectively used in place of the first hub harness for connecting said hub end of the cable bundle to a second associated source of video signals;

a first monitor harness for connecting a lower end of the cable bundle to said first associated monitor device; and, a second monitor harness selectively used in place of the first monitor harness for connecting said lower end of the cable bundle to a second associated monitor device, wherein said cable bundle includes:

a set of hub connectors provided on said hub end of the cable bundle, a first one of said set of hub connectors for selective connection of the cable bundle with said first hub harness to use said first associated source of video signals with said cable bundle, and a second one of said set of hub connectors for selective connection of the cable bundle with said second hub harness to use said second associated source of video signals with said cable bundle; and, a set of monitor connectors provided on said lower end of the cable bundle, a first one of said set of monitor connectors for selective connection of the cable bundle with said first monitor harness to use said first associated monitor device with said cable bundle, and a second one of said set of monitor connectors for selective connection of the cable bundle with said second monitor harness to use said second associated monitor device with said cable bundle.

5. The convertible electrical connect system according to claim 4 wherein said cable bundle includes a plurality of individual cables to carry/transmit power, video, data, and other signals between said hub and lower ends of the cable bundle.

6. The convertible electrical connect system according to claim 5 wherein said plurality of individual cables in said cable bundle are shielded and isolated.

7. A convertible electrical connect system for use with an associated surgical equipment suspension arm connected at a hub end to a central hub for attaching the suspension arm to a ceiling of an associated operating room, the suspension arm having a lower end opposite said hub end carrying a monitor support shelf adapted to support a first associated monitor device, the convertible electrical connect system comprising:

a cable bundle extending along said monitor suspension arm;

a first hub harness for connecting a hub end of the cable bundle to a first associated source of video signals; and, a first monitor harness for connecting a lower end of the cable bundle to said first associated monitor device, wherein said cable bundle includes:

a set of hub connectors provided on said hub end of the cable bundle for selective connection with said first hub harness; and, a set of monitor connectors provided on said lower end of the cable bundle for selective connection with said first monitor harness.

8. The convertible electrical connect system according to claim 7 wherein said cable bundle includes a plurality of individual cables to carry/transmit power, video, data, and other signals between said hub and lower ends of the cable bundle.

9. The convertible electrical connect system according to claim 8 wherein said plurality of individual cables in said cable bundle are shielded and isolated.

10. In combination:

a surgical equipment suspension arm connected at a hub end to a central hub for attaching the suspension arm to a ceiling of an associated operating room, the suspension arm having a lower end opposite said hub end carrying a monitor support shelf adapted to support a first associated monitor device; and, a video/data quick connect system including:

a cable bundle extending along said monitor suspension arm;

a first hub harness for connecting a hub end of the cable bundle to a first associated source of video signals;

a set of hub connectors provided on said hub end of the cable bundle, a first one of said set of hub connectors for selective connection of the cable bundle with said first hub harness to use said first associated source of video signals with said cable bundle, and a second one of said set of hub connectors for selective connection of the cable bundle with a second associated hub harness to use a second associated source of video signals with said cable bundle;

a first monitor harness for connecting a lower end of the cable bundle to said first associated monitor device; and, a set of monitor connectors provided on said lower end of the cable bundle, a first one of said set of monitor connectors for selective connection of the cable bundle with said first monitor harness to use said first associated monitor device with said cable bundle, and a second one of said set of monitor connectors for selective connection of the cable bundle with a second associated monitor harness to use a second associated monitor device with said cable bundle.

11. The combination according to claim 10 wherein said video/data quick connect system includes:

said second hub harness for connecting said hub end of the cable bundle to a second associated source of video signals.

12. The combination according to claim 10 wherein said video/data quick connect system includes:

said second monitor harness for connecting said lower end of the cable bundle to a second associated monitor device.

13. The combination according to claim 10 wherein said video/data quick connect system includes:

said second hub harness for connecting said hub end of the cable bundle to a second associated source of video signals; and, said second monitor harness for connecting said lower end of the cable bundle to a second associated monitor device.

14. The combination according to claim 10 wherein said cable bundle includes a plurality of individual cables to carry/transmit power, video, data, and other signals between said hub and lower ends of the cable bundle.

15. The combination according to claim 14 wherein said plurality of individual cables in said cable bundle are shielded and isolated.

16. The convertible electrical connect system according to claim 10 wherein said cable bundle includes a plurality of individual cables to carry/transmit power, video, data, and other signals between said hub and lower ends of the cable bundle.

17. The convertible electrical connect system according to claim 16 wherein said plurality of individual cables in said cable bundle are shielded and isolated.

* * * * *